United States Patent [19]

Sekiguchi et al.

[11] 3,976,737

[45] Aug. 24, 1976

[54] PROCESS FOR PRODUCING HIGH SHRINKING ACRYLIC FIBER

[75] Inventors: Hideto Sekiguchi; Masao Sone; Mitsunori Sato, all of Okayama, Japan

[73] Assignee: Japan Exlan Company Limited, Osaka, Japan

[22] Filed: Sept. 13, 1973

[21] Appl. No.: 396,776

[30] Foreign Application Priority Data

Sept. 14, 1972 Japan ..... 47-92344

[52] U.S. Cl. ..... 264/182; 264/210 F

[51] Int. Cl.[2] ..... D01F 6/18

[58] Field of Search ..... 264/182, 210 F

[56] References Cited

UNITED STATES PATENTS

| | | | |
|---|---|---|---|
| 3,412,191 | 11/1968 | Kitajima et al. | 264/182 |
| 3,463,846 | 8/1969 | Nakagawa et al. | 264/182 |
| 3,485,913 | 12/1969 | Yamada et al. | 264/182 |
| 3,523,150 | 8/1970 | Vigneault | 264/182 |
| 3,562,378 | 2/1971 | Fujita et al. | 264/182 |
| 3,621,087 | 11/1971 | Shimamora et al. | 264/182 |
| 3,673,053 | 6/1972 | Shimoda et al. | 264/182 |
| 3,706,828 | 12/1972 | Tzentis | 264/182 |
| 3,812,004 | 5/1974 | Chinai et al. | 264/182 |
| 3,851,036 | 11/1974 | Tzentis | 264/182 |
| 3,885,013 | 5/1975 | Sato | 264/182 |

*Primary Examiner*—Jay H. Woo

*Attorney, Agent, or Firm*—Wenderoth, Lind & Ponack

[57] ABSTRACT

The present invention relates to a process for producing high shrinking acrylic fibers which have excellent antipilling properties and dyeing characteristics. This process involves dissolving an acrylonitrile polymer in an inorganic solvent to prepare a spinning solution containing the inorganic solvent in a concentration of 40–70%, subjecting the spinning solution to a wet-spinning by extruding through spinnerette orifices into two coagulating baths, while maintaining the linear velocity ratio of free extrusion at 1 or higher and maintaining a jet stretch ratio of 1.5 or higher, stretching the formed swollen gel fibers to 3–7 times the length in hot water or in a heated steam medium at 80°–120°C, drying the stretched fibers, then subjecting the fibers to a secondary stretch of 1.05 to 1.60 times the length, wherein the first coagulating bath has an inorganic solvent concentration of 50–70% of that in the spinning solution. The jet stretch ratio is defined as being the quotient obtained by dividing the take-up speed of the coagulated filaments from the coagulating baths by the extrusion linear velocity of the fiber-forming polymer through the spinnerette orifices.

3 Claims, 3 Drawing Figures

PROCESS FOR PRODUCING HIGH SHRINKING ACRYLIC FIBER

The present invention relates to a new process for producing high shrinking acrylic fibers and more particularly to a new process for producing high shrinking acrylic fibers having a remarkably stabilized dyeing speed.

To make acrylic fibers bulky, there are known processes of imparting potential shrinkability or crimp developability thereto, wherein the filaments that have passed through the steps of spinning, stretching, drying and relaxing heat treatment in the usual way are stretched or given a tensioning treatment. For example, Japanese Patent Publication No. 8111/1961, etc. propose processes of controlling the shrinkability or crimpability of the fiber under treatment by subjecting the filaments to a secondary stretching or tensioning treatment under the action of dry heat. The thus-obtained high shrinking acrylic filaments are thereafter cut into desired lengths to be formed into staple fibers or further into slivers. The fibers or slivers are then blended with staple fibers or slivers of lower heat shrinkability and formed into yarns or woven or knitted fabrics, which are finally subjected to bulk development, e.g. by means of boiling treatment to be formed into bulky spun yarns or woven or knitted fabrics. However, the foregoing high shrinking acrylic fiber blended with a lower shrinking component is greatly changed in the fine structure of fiber by the secondary stretching for making the shrinkability potential which is carried out after the relaxing beat treatment. That is to say, after the high shrinking fiber is subjected to the bulk development after the secondary stretching, for example by means of steam heat or boiling water, non-restoring regions due to the secondary stretching still remain in the fiber structure. Consequently, the final fiber after being shrunk by the bulk development has several defects in the physical properties. Among the fiber properties, the dyeing speed is especially sensitively influenced by the fine structure of fiber, so that it is not uncommon that the acrylic fiber after the secondary stretching is remarkably changed in the dyeing speed. Therefore, a disadvantage is seen which causes unevenness in dyeability in blended yarn composed of the thus-obtained high shrinking acrylic fiber and non-shrinking fiber or in woven or knitted fabrics produced from such blended yarn. Also, in the high shrinking acrylic fiber bundle after the secondary stretching, a disadvantage is seen which changes the dyeing speed between individual fibers forming the fiber bundle, due to unevenness in the potential shrinkability. In the practical side, in the dyeing of bulky yarn obtained by blend-spinning non-shrinking or low shrinking fiber and high shrinking fiber or bulky woven or knitted fabrics obtained therefrom, such changes in the dyeing speed due to the secondary stretching give rise to unevenness in dyed color ascribable to the difference in the dyeing speed of the two components which remarkably impairs the commercial value of the final products. The solution of such troubles has been strongly desired by the people in this field of the industry, since such troubles are fatal defects in using high shrinking acrylic fibers as material for forming yarn or woven or knitted fabrics.

We have made an intensive study to establish an industrial means which will remove the foregoing troubles incidental to conventional techniques. As a result, we have attained the present invention by finding that when a specific coagulation step and a specific secondary stretching step are combined, there can be provided a high shrinking acrylic fiber having an even dyeing speed and moreover remarkably improved in the anti-pilling property of the final products.

One of the main objects of the present invention is to provide a high shrinking acrylic fiber which is reduced in the change of dyeing speed and stabilized well in the fiber quality in dyeing.

Another main object of the present invention is to provide a process for producing a new high shrinking acrylic fiber which is not only stabilized in dyeing speed but also remarkably improved in the anti-pilling property of the final products.

Further objects of the present invention will become apparent from the following description.

These objects of the present invention can be effectively attained by the provision of a process for producing a high shrinking acrylic fiber wherein a spinning solution prepared by dissolving as acrylic polymer in an inorganic solvent is wet-spun through spinnerette orifices, with the linear velocity ratio of a free extrusion maintained above 1 and the jet stretch ratio above 1.5, and the thus-obtained swollen gel fiber is stretched 3 to 7 times the initial length, dried, subjected to relaxing heat treatment and further to a secondary stretching of 1.05 to 1.60 times.

Prior to go into detailed explanation of the process of the present invention, some explanations on the linear velocity ratio of a free extrusion defined in the present invention are given in the following.

Figure 1:
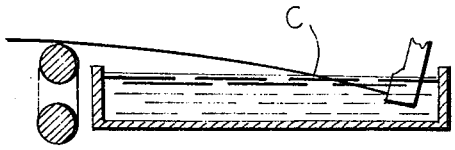
FIG. 1 is an example of the horizontal type coagulation bath for measuring linear velocity ratio of a free extrusion.

In known wet spinning processes, the coagulation medium for the spinning solution (dope) extruded through spinnerette orifices is a liquid. Thus, to facilitate the circulation of coagulation bath stream and the take-up of the coagulated filaments, it has been common practice to use a horizontal type coagulation bath as shown in FIG. 1. The spinning solution extruded through the spinnerette orifices travels nearly horizontally through the coagulation bath while being removed from the solvent, and the resulting filaments are withdrawn from the coagulation bath.

In the coagulation step of spinning solution by such wet spinning process, we observed the behavior of fiber formation by varying the takeup speed of the coagulated filaments, while maintaining the extrusion linear velocity of the spinning solution through the spinnerette orifices constant. As a result, we have found that the desolvation behavior of swollen gel filaments travelling through the coagulation bath can be quantitatively grasped as a variation of the takeup tension of the swollen gel filaments, and that the takeup tension is predominantly affected by the concentration of the fiber-forming polymer in the spinning solution to form the coagulated filaments and by the composition of the coagulation bath.

More precisely explaining, when only the takeup speed of the coagulated filaments is increased, with the linear velocity of the spinning solution through the spinnerette orifices maintained constant, the takeup tension of the coagulated filaments will gradually increase to break the filaments finally. On the contrary, according as the takeup speed is decreased, the tension of the coagulated filaments gradually decreases to reach a relaxed condition substantially free from the influence of external force except the weight itself of the coagulated filaments. Such variation of the takeup tension of the coagulated filaments is influenced by the desolvation behavior of the spinning solution extruded into the coagulation bath through the spinnerette orifices. However, essentially, the desolvation behavior is more greatly influenced by the concentration of the fiber-forming polymer in the spinning solution as well as the composition of the coagulation bath. In the former case, that is, in the behavior of breaking the coagulated filaments under tension, the takeup speed upon breaking of the coagulated filaments is usually called maximum takeup speed, and the quotient obtained by dividing the maximum takeup speed by an extrusion linear velocity of spinning solution from the spinnerette orifices is defined as maximum jet stretch ratio, which is used as a physical quantity to evaluate the spinnability. However, usually in the industrial scale practice, spinnerettes having a large number of orifices are used. Thus, it is rather unusual that the coagulated filaments will be broken uniformly at one time as a whole filament bundle by increased takeup tension. Accordingly, it is quite impractical to use the maximum jet stretch ratio measured on a single coagulated filament as a physical quantity expressing the spinnability or filament-forming characteristics of the extruded fiber bundle. Such a tensency of coagulation behavior is particularly noticed when the coagulation ability of the coagulation bath is small for the extruded spinning solution, that is, when the coagulation rate of the swollen gel fiber in the coagulation bath is slow. Also, we made a detailed study on the latter case, that is, in the desolvation behavior and fiber-forming behavior of the extruded filaments in a relaxed condition in which the takeup speed of the coagulated filaments is decreased to reduce the takeup tension of the filaments. As a result, we noticed that the takeup speed in a condition in which the coagulated filaments are given the lowest pollible takeup tension sufficient to maintain a tensioned state between the spinnerette orifices and the drawing rollers from coagulation bath, has a special significance as a physical quantity expressing the free extrusion state of the spinning solution, in which there is no practical influence of external force on the coagulated filaments except the weight itself of the filaments. We call such extrusion velocity of the spinning solution as a linear velocity of free extrusion, and the quotient obtained by dividing linear velocity of a free extrusion by the extrusion velocity of the spinning solution through the spinnerette orifices is defined as the linear velocity ratio of a free extrusion. By the use of the linear velocity ratio of a free extrusion in combination with the foregoing jet stretch ratio, it has become possible to solve the fiber forming behavior as well as desolvation behavior of the coagulated filaments in the coagulation step more clearly.

In a more detailed explanation, the linear velocity ratio of a free extrusion is not only useful as a practical measure for evaluating the spinnability but has a physicochemical significance as a measure for quantitatively expressing the volumetric diminution rate due to desolvation of the swollen gel fiber in the coagulation bath. Namely, in the case of a large desolvation rate, the volumetric diminution tendency of the extruded swollen gel filaments is large, so that the linear velocity ratio of a free extrusion becomes reduced. On the contrary, when the desolvation rate is small, the volumetric diminution rate of the swollen gel filaments in the coagulation step becomes reduced to increase the linear velocity ratio of a free extrusion.

By measuring the linear velocity ratio of a free extrusion while varying the concentration of the fiber-forming polymer contained in the spinning solution as well as the composition of the coagulation bath, we quantitatively elucidated the desolvation behavior and fiber forming behavior, the elucidation of which is effective for the improvement of anti-pilling and level dyeing properties of the fiber.

In a more concrete explanation, while varying the concentration of the fiber-forming polymer in the spinning solution and the composition of the coagulation bath, the coagulated filaments are made to travel in a straight line between the spinnerette orifices and the drawing rollers under the takeup tension, as shown in FIG. 1. In such a condition, obtain the leaving point C of the coagulated filaments from the coagulation bath surface into an inert medium such as air. The, reduce the takeup speed gradually so that the coagulated filaments are suspended in a relaxed condition between the spinnerette orifices and the drawing rollers, and observe the movement of the leaving point C. Namely, with the decrease of the takeup tension, the leaving point C of the coagulated filaments from the coagulation bath surface gradually moves toward the drawing roller side. Now, hold the coagulated filaments straight in a tensioned state between the spinnerette orifices and the drawing rollers. The while reducing the takeup speed, read at the moment when a movement of the leaving point C takes place, that is, the takeup speed at the very moment of moving from a tensioned state to a relaxed state.

Figure 2:
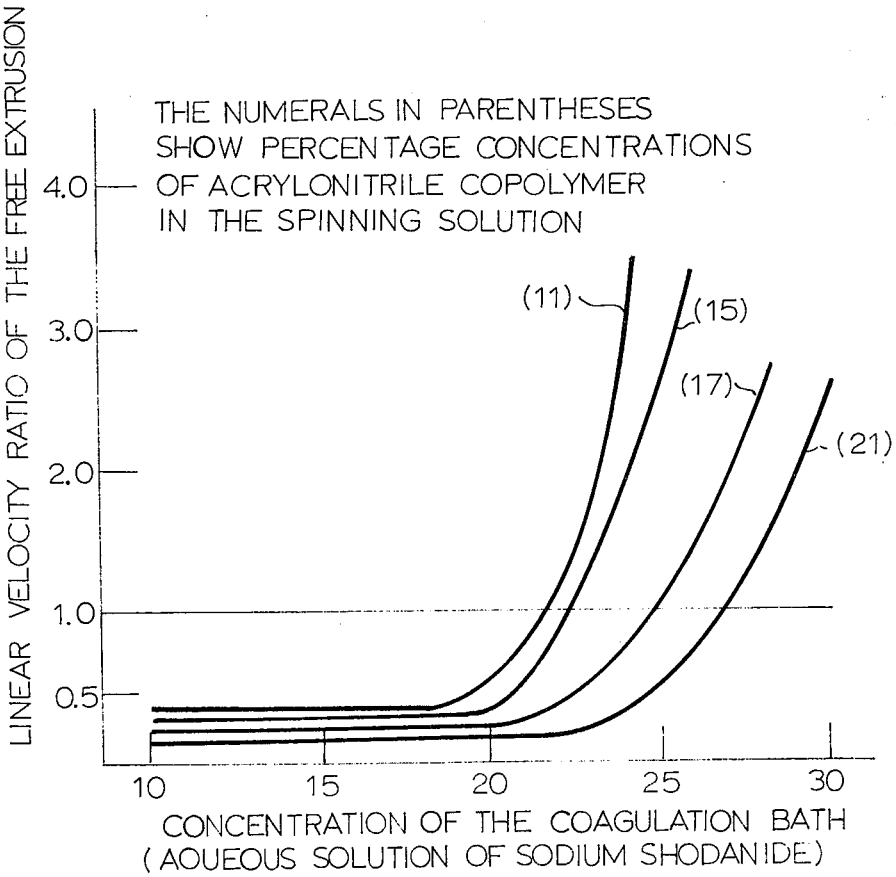
FIG. 2 is an orthogonal coordinate diagram exemplifying the ratio between the linear velocity ratio of a free extrusion and coagulation bath composition.

In the production of acrylic fibers, FIG. 2 shows an example of the relation between the linear velocity ratio of a free extrusion and coagulation bath composition, as observed with varying concentration of the fiber-forming polymer in the spinning solution, in the case of using a horizontal coagulation bath in which the immersion length of the coagulated filaments is 300 mm. and the temperature is maintained at −3°C.

As a result of repeating a series of systematic experiments on the basis of the above-mentioned knowledge, we have found that, in order to stabilize the dyeing speed of acrylic fibers and to improve the anti-pilling property of the final products produced from said fibers, it is necessary that a spinning solution prepared by dissolving an acrylonitrile polymer is an inorganic solvent should be wet-spun through spinnerette orifices, with the free extrusion linear velocity ratio maintained above 1 and the jet stretch ratio above 1.5, and the thus-obtained swollen gel fiber should be stretched, dried, subjected to relaxing heat treatment and further to a secondary stretching of 1.05 to 1.60 times.

In the practice of the present invention, to maintain the linear velocity ratio of a free extrusion within the range above 1, the concentration of the inorganic solvent used in the coagulation bath is desirably adjusted to the range of 50 to 70 % with respect to the concentration of the inorganic solvent used for dissolving the acrylonitrile polymer in preparing the spinning solution.

Desirably, such concentration of the inorganic solvent used in preparing the spinning solution in the present invention is in the range of 40 to 70 %.

In the case that the composition of the coagulation bath goes out of the foregoing preferred range, it is pratically impossible to maintain the spinning solution extruded through the spinnerette orifices at the linear velocity ratio of a free extrusion above 1 and it becomes also difficult to maintain a jet stretch ratio above 1.5, which together with the foregoing the linear velocity of a free extrusion, is effective for the improvement of anti-pilling and level dyeing properties as well as anti-fibrillation, and for obtaining a moderate dyeing speed.

In the range in which the jet stretch ratio is less than 1.5, the gel filaments extruded into the coagulation bath become excessively sagged and consequently wind around the drawing rollers on being drawn from the coagulation bath and thus the spinnability becomes seriously lowered. Moreover, in the case of using a jet stretch ratio of less than 1.5, however the process conditions in the subsequent 3 – 7 times stretching in a gel state, drying step, relaxing heat treatment step, of the secondary stretching step may be regulated, it becomes difficult to impart to the extruded fiber a degree of orientation necessary for the improvement of stress-strain property, and therefore the stress-strain property of the final products, which is a secondary effect of the present invention, is greatly lowered. Accordingly, in order to maintain the dyeing and stress-strain characteristics in a range satisfactory for practical use and yet with an improvement of the stability in dyeing speed and the anti-pilling property, it is necessary to give the linear velocity ratio of a free extrusion above 1 and a jet stretch ratio above 1.5 to the spinning solution at the same time in the coagulation step.

As another embodiment of the present invention, the following two-stage coagulation process can be carried out without departing from the purport of the invention so far as the first bath satisfies the foregoing preferred range of the linear velocity ratio of a free extrusion and jet stretch ratio. Namely, after the first-stage coagulation step satisfying the above-mentioned linear velocity ratio of a free extrusion and jet stretch ratio, the coagulated filaments are further introduced into a second-stage coagulation bath having a solvent concentration of 20 to 35 % based on the concentration of the solvent used for the preparation of the spinning solution.

When the stretch ratio given to the swollen gel fiber before drying is less than 3, the linear velocity of takeup from the coagulation bath is greatly increased, so that the coagulation bath flies about, or filament breaking takes place frequently because the single filament denier of the unstretched swollen gel fiber is made extremely fine. Such disadvantages interrupt stable spinning. On the contrary, in the region where the stretch ratio of the swollen gel fiber before drying is in excess of 7, the degree of orientation of the extruded fiber is increased excessively to make it impossible to maintain the strength level of the fiber effective for the improvement of anti-pilling property, and the potential shrinkability imparted to the acrylic fiber in the subsequent secondary stretching step is made smaller to remarkably lower the dyeing speed and impair the level dyeing property of the final fiber. Therefore, such a region of stretch ratio is not desirable.

In the present invention, the 3 – 7 times stretching for the swollen gel fiber before drying means a stretching in hot water or in a heated steam medium at 80° to 120°C., and can be carried out irrespective of the spinning speed and single filament denier so far as the linear velocity ratio of a free extrusion and the jet stretch ratio are maintained within the above-mentioned preferred ranges.

The swollen gel fiber that has passed through the foregoing stretching step is thereafter dried to compact the fiber structure and then further subjected to relaxing heat treatment in a hot air current or in a wet heat atmosphere. This relaxing heat treatment is carried out at a low temperature in comparison with the conventional relaxing heat treatment condition for acrylic fibers, that is, in a hot air current below 150°C. or in a wet heat atmosphere below 120°C., preferably for less than 15 minutes. By the use of such a peculiar relaxing heat treatment condition, it is possible to impart to the final fiber a shrinking ratio below 12 % which is effective for the improvement of the anti-pilling property as well as the level dyeing property due to the decrease of dyeing speed.

The shrinking imparted to the final fiber in the present invention means a heat shrinkability imparred to the acrylic fiber by relaxing heat treatment after the drying step in dry or wet atmosphere, and more concretely it is the quotient represented in percentage obtained by dividing the value of the fiber length after drying minus the fiber length after relaxing heat treatment by the fiber length after drying.

The acrylic fiber that has passed through the foregoing relaxing heat treatment is supplies to a known Turbo Stapler or the like to be subjected to the secondary stretching of 1.05 to 1.60 times in a dry heat atmosphere at 80° to 200°C., preferably 120° to 180°C., and then cut into desired fiber lengths. When the shrinking ratio imparted to the fiber in the relaxing heat treatment step before the secondary stretching is in excess of 12 %, the dyeing speed of the potentially shrinkable acrylic fiber after the secondary stretching is greatly decreased in comparison with the dyeing speed of a non-shrinking or low shrinking acrylic fiber that has not passed through such secondary stretching, and furthermore the dyeing speed itself is easily changed by the change of the secondary stretching ratio. Thus, such a shrinking ratio makes it extremely difficult to impart a stable dyeing speed to the final fiber, which is one of the main objects of the present invention.

As mentioned above, the preferred range of the secondary stretching ratio in the practice of the present invention is from 1.05 to 1.60 times. If the secondary stretching ratio is less than 1.05 times, it becomes difficult to make potential shrinkability required for the fiber in viewpoint of practical use, so that the bulkiness of the final products is impaired. Also, in the region where the secondary stretching ratio is in excess of 1.60 times, filament breaking takes place frequently to make the operation unstable and the knot properties of the fiber are lowered to impair the commercial value of the acrylic fiber finally obtained.

The expression "high shrinking acrylic fibers" as referred to in the present invention is a generic term for the fibers composed of an acrylonitrile polymer containing at least 80 % by weight of combined acrylonitrile, and obtained by passing the spinning solution of said polymer through a coagulation step in which the linear velocity ratio of a free extrusion and jet stretch ratio are maintained in specific ranges, subjecting the thus-obtained fiber to a stretching treatment of a low stretching ratio, drying treatment, a low temperature relaxing heat treatment, and then a secondary stretching of 1.05 to 1.60 times. Representative compounds which may be copolymerized with acrylonitrile to form acrylonitrile polymers useful for the present invention are compounds containing a single $CH_2{=}C<$ group, for instance vinyl esters especially the vinyl esters of saturated aliphatic monocarboxylic acids, e.g. vinyl acetate, vinyl propionate, vinyl butyrate, etc.; vinyl halides and vinylidene halides, e.g. vinyl chloride, vinyl bromide, vinyl fluoride, vinylidene chloride, vinylidene bromide, vinylidene fluoride, etc.; allyl-type alcohols, e.g. allyl alcohol, methallyl alcohol, ethallyl alcohol, etc.; allyl, methyl and other unsaturated monohydric alcohol esters of monobasic acids, e.g. allyl and methallyl acetates, laurates, cyanides, etc.; acrylic and alkacrylic acids (e.g. methacrylic, ethacrylic, etc.) and esters and amides of such acids (e.g. methyl, ethyl, propyl, butyl, etc. acrylates and methacrylates, acrylamide, methacrylamide, N-methyl, -ethyl, -propyl, butyl, etc. acrylamides and methacrylamides, etc.); methacrylonitrile, ethacrylonitrile, and other hydrocarbon-substituted acrylonitriles; unsaturated sulfonic acids containing a single $CH_2{=}C<$ group and their salts, e.g. allylsulfonic acid, methallylsulfonic acid, styrene sulfonic acid, and their sodium and potassium salts; unsaturated aliphatic hydrocarbons containing a single $CH_2{=}C<$ group, e.g. isobutylene; and numerous other vinyl, acrylic and other compounds containing a single $CH_2{=}C<$ group which are copolymerizable with acrylonitrile to yield thermoplastic copolymers. Alkyl esters of alpha, beta-unsaturated polycarboxylic acids may also be copolymerized with acrylonitrile to form copolymers, e.g. dimethyl, -ethyl, -butyl, etc. esters of maleic, fumaric, citraconic, etc. acids.

Among the inorganic solvents which may be used in the present invention may be mentioned: rhodanides e.g. sodium rhodanide, potassium rhodanide, ammonium rhodanide and calcium rhodanide and mixture of these rhodanides; concentrated aqueous solutions of inorganic salts, e.g. zinc chloride, lithium chloride, etc.; and concentrated aqueous solutions of inorganic acids, e.g. sulfuric acid, nitric acid, etc.

As apparent from the foregoing explanations, the coagulation bath may be a same aqueous inorganic solvent solution as used in the preparation of the spinning solution, however in concentration of 50 to 70 % with respect to the concentration of the inorganic solvent in the spinning solution.

For the sake of convenience, the explanation of the linear velocity ratio of a free extrusion in the previous paragraphs has been made on the filament formation using a horizontal type coagulation bath. However, once the inorganic solvent compositions of the spinning solution and coagulation bath which are able to maintain the linear velocity ratio of a free extrusion above 1 are obtained, any type of coagulation bath other than horizontal type bath may be used to attain the action and effect of the present invention effectively.

The process of the present invention displays remarkable effects by the combined use of the foregoing constitutional requirements of the invention. Particularly, no substantial change is seen in the dyeing speed before and after the secondary stretching step, and the dyeing speed is maintained extremely stable against the change of the secondary stretching ratio.

Accordingly, in the bulky spun yarn or woven or knitted fabrics produced therefrom, there is seen no unevenness of dyed color due to the difference in the dyeing speed between the high shrinking acrylic fiber and a nonshrinking or low shrinking fiber. Therefore, the commercial value of the final products can be greatly improved.

By the combined use of the peculiar coagulation step, stretching step, relaxing heat treatment step and the secondary stretching step proposed in the present invention, the final products posses a remarkably improved anti-pilling property while retaining a stress-strain property sufficient for practical use. Thus, the present invention assures improved anti-pilling property and stability of latent shrinkability to the obtained acrylic fiber, so, the quality of the final products are remarkably improved.

Besides, as the other effects of the process of the present invention, we can mention easiness of spinning non-circular cross section fiber or fine denier fiber and improvement of fiber luster. Furthermore, the process of the present invention reduces the roller lead in the secondary stretching and facilitates the filament cutting after the secondary stretching as that there is no problem in its practice on an industrial scale.

The present invention is further explained by examples but the claims of the invention is not limited by the description in the examples.

The parts and percentages in the examples are shown by weight unless otherwise indicated.

EXAMPLE 1

An acrylonitrile copolymer consisting of 91 parts of acrylonitrile, 9 parts of methyl acrylate and 0.5 part of sodium methallyl sulfonate was dissolved in aqueous solutions of sodium rhodanide to prepare spinning solutions, of which the polymer concentrations and solvent concentrations are shown in Table 1.

Thethus-obtained spinning solutions were extruded through the spinnerette which have circular orifices into low temperature coagulation baths of various concenatrations of sodium rhodanide while varying the linear velocity ratio of a free extrusion and jet stretch ratio to form swollen gel filaments. Thereafter, according to the process conditions mentioned in Table 1, the filaments were subjected to stretching, drying, relaxing heat treatment and secondary stretching, to form high shrinking acrylic fibers of 3 denier single filaments. The ratios of decrease in dyeing speed after the secondary stretching of the thus-obtained high shrinking acrylic fibers are also mentioned in Table 1.

Table 1

| | Spinning solution | | Coagulation bath | | | Stretching conditions for swollen gel fiber | |
|---|---|---|---|---|---|---|---|
| Exp. No. | Polymer conc. (%) | NaSCN conc. (%) | NaSCN conc. (%) | L.V.R.F.E. (*) | Jet stretch ratio | Temp. of heating medium | Stretch ratio |

Table 1-continued

| | | | | | | | |
|---|---|---|---|---|---|---|---|
| 1 | 17 | 50 | 22 | 0.40 | 1.50 | — | — |
| 2 | 11 | 44 | 22 | 1.15 | 0.39 | — | — |
| 3 | 13 | 46 | 23 | 1.90 | 1.26 | Boiling water | 11.0 |
| 4 | 11 | 44 | 12 | 0.35 | 0.39 | " | 10.0 |
| 5 | 17 | 50 | 25 | 1.10 | 8.17 | " | 2.0 |
| 6 | 11 | 44 | 22 | 1.15 | 1.96 | Water at 90°C. | 6.0 |
| 7 | 11 | 44 | 23 | 1.50 | 1.26 | Boiling water | 10.5 |
| 8 | 17 | 50 | 26 | 1.50 | 2.38 | Water at 85°C. | 4.5 |
| 9 | 11 | 44 | 23 | 1.90 | 1.59 | Water at 90°C. | 6.0 |
| 10 | 17 | 50 | 26 | 1.50 | 2.30 | Water at 85°C. | 4.5 |
| 11 | 17 | 50 | 25 | 1.10 | 2.25 | Boiling water | 4.5 |
| 12 | 15 | 48 | 25 | 2.60 | 3.05 | Water at 80°C. | 3.0 |
| 13 | 11 | 44 | 23 | 1.50 | 1.66 | Boiling water | 7.0 |
| 14 | 13 | 46 | 24 | 2.90 | 3.49 | Water at 85°C. | 3.5 |

| Exp. No. | Shrinking ratio of fiber by relaxing heat treatment (%) | Temp. of heating medium | Ratio of decrease in dyeing speed after the secondary stretching — Stretching ratio 1.32 | 1.44 | 1.50 | Remarks |
|---|---|---|---|---|---|---|
| 1 | — | — | — | — | — | Spinning was impossible; frequent filament breaking and winding around the rollers |
| 2 | — | — | — | — | — | Continuous spinning was impossible; sagging of swollen gel fiber in the coagulation bath |
| 3 | 22.2 | Wet heat, 130°C. | 24.3 | 32.5 | 41.1 | Excessive decrease in dyeing speed after secondary stretching; much unevenness is dyed color |
| 4 | 18.8 | Wet heat, 125°C. | 7.3 | 10.3 | 24.5 | " |
| 5 | — | — | — | — | — | Spinning was impossible; frequent filament breaking |
| 6 | 19.2 | Wet heat, 127°C. | 2.5 | 7.0 | 28.7 | Excessive decrease in dyeing speed after secondary stretching; much unevenness in dyed color |
| 7 | 0 | — | −7.6 | −3.6 | Stretching impossible | — |
| 8 | 6 | Wet heat, 110°C. | −6.8 | −1.0 | 1.7 | — |
| 9 | 6.1 | Hot air, 150°C. | −2.2 | 5.7 | 8.9 | — |
| 10 | 2.5 | Hot air, 130°C. | −2.8 | −1.5 | 1.0 | — |
| 11 | 3.6 | Wet heat, 105°C. | 1.0 | 5.9 | 9.5 | — |
| 12 | 2.3 | Wet heat, 100°C. | −1.5 | 1.0 | 1.2 | — |
| 13 | 2.8 | Hot air, 130°C. | −2.7 | −3.5 | 3.5 | — |
| 14 | 11.2 | Wet heat, 115°C. | 2.2 | 7.1 | 9.5 | — |

(*)L.V.R.F.E. = the linear velocity ratio of a free extrusion.

In Example 1, the decrease in dyeing speed after the secondary stretching of the high shrinking acrylic fiber is the quotient represented by percentage obtained by dividing the value of the dyeing speed of the fiber before the secondary stretching minus the dyeing speed of the fiber after the secondary stretching by the dyeing speed of the fiber before the secondary stretching. In order that visual color difference is not recognized in blended yarn composed of the high shrinking acrylic fiber and a low shrinking fiber or non-shrinking fiber or in woven or knitted fabrics produced therefrom, the ratio of decrease in the dyeing speed of the fiber should be maintained within the range of ±10 %.

Figure 3:
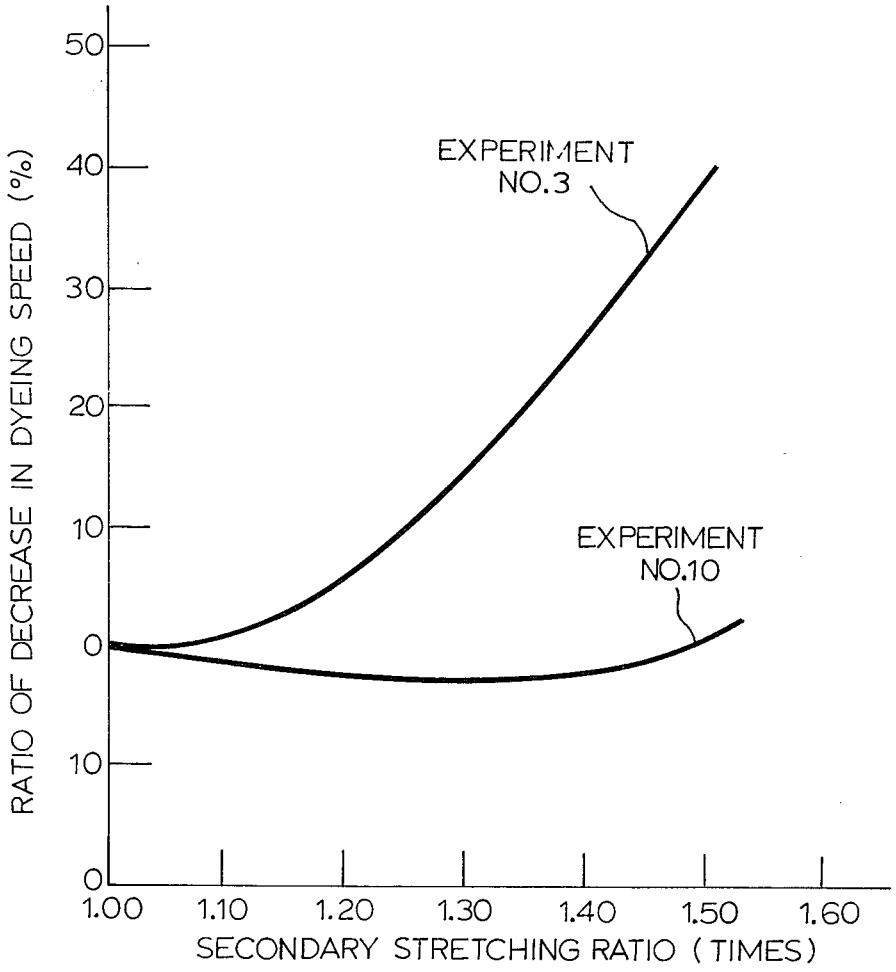
FIG. 3 is an orthogonal coordinate diagram exemplifying the dependance of the ratio of decrease in dyeing speed on the change of the secondary stretching ratio.

FIG. 3 is an example showing the dependence of the ratio of decrease in dyeing speed on the change of the secondary stretching ratio as shown with the acrylic fiber produced according to the conventional process (Exp. No. 3 in Example 1) and the high shrinking acrylic fiber according to the process of the present invention (Exp. No. 10).

The samples of Exp. Nos. 3, 4 and 6 which are out of the conditions defined by this invention were high in the decrease in the dyeing speed after the secondary stretching so that the textile products prepared by mixing these fibers with low shrinking or non-shrinking acrylic fibers were extremely uneven in dyeability. In contrast thereto, the samples of Exp. Nos. 8 – 14 satisfying all the requirements of this invention were very slight in the decrease in the dyeing speed after the secondary stretching so that the textile products prepared by mixing these fibers with low shrinking or non-shrinking acrylic fibers showed even dyeability.

EXAMPLE 2

Equal amounts of the non-shrinking acrylic fiber mentioned in Example 1 which was not subjected to the secondary stretching and a high shrinking acrylic fiber which was subjected to the secondary strethcing of a stretching ratio of 1.32 times at a heater plate temperature of 120°C. were mixed to produce spun yarn. The spun yarn was immersed in boiling water for 45 minutes to develop bulk and the bulked yarn was made into a knitted fabric, which was measured for the anti-pilling property on a I.C.I. pilling Tester. The result was that while the knitted fabrics made of the acrylic fibers of Exp. Nos. 3 and 4, of which the production conditions deviated from the constitutional requirements of the present invention, produced remarkable pills (pill grade: Class 1 to Class 2), while, the knitted fabric made of the high shrinking acrylic fibers of from Exp. No. 8 through No. 14 of which the production conditions completely satisfied the constitutional requirements of the present invention showed no substantial generation of pills (pill grade: Class 4 to Class 5).

What we claim is:

1. A process for producing high shrinking acrylic fibers which comprises dissolving an acrylonitrile polymer in a rhodanide solvent to prepare a spinning solution containing the rhodanide solvent in a concentration of 40–70%, subjecting the spinning solution to a wet-spinning by extruding through spinnerette orifices into two coagulating baths each containing a rhodanide solvent therein, while maintaining the linear velocity ratio of free extrusion at 1 or higher and maintaining a jet stretch ratio of 1.5 or higher, stretching the formed swollen gel fibers to 3–7 times the length in hot water or in a heated steam medium at 80°–120°C, drying the stretched fibers, then subjecting the fibers to a secondary stretch of 1.05 to 1.60 times the length, wherein the first coagulating bath has a rhodanide solvent concentration of 50–70% of that in the spinning solution; said jet stretch ratio being defined as the quotient obtained by dividing the takeup speed of the coagulated filaments from the coagulating baths by extrusion linear velocity of the fiber-forming polymer through the spinning orifices.

2. A process as claimed in claim 1 wherein the concentration of the rhodanide solvent in the second coagulation bath is 20 - 35 % of that in the spinning solution.

3. A process according to claim 1, wherein the inorganic solvent is selected from the group consisting of sodium rhodanide, potassium rhodanide, ammonium rhodanide, calcium rhodanide and mixtures thereof.

* * * * *